US005193557A

United States Patent [19]

Hogan

[11] Patent Number: 5,193,557

[45] Date of Patent: Mar. 16, 1993

[54] HAIR TREATMENT APPLIANCE

[76] Inventor: Gary L. Hogan, Rte. 2, Box 215A, Leesville, S.C. 29070

[21] Appl. No.: 808,433

[22] Filed: Dec. 16, 1991

[51] Int. Cl.[5] ..... A45D 24/22

[52] U.S. Cl. ..... 132/112; 132/148

[58] Field of Search ..... 132/112, 148, 126, 147

[56] References Cited

U.S. PATENT DOCUMENTS

| | | | |
|---|---|---|---|
| 2,218,471 | 10/1940 | Hickey | 132/112 X |
| 3,516,424 | 6/1970 | Eagle | 132/148 |
| 3,960,160 | 6/1976 | Hogan | 132/207 X |
| 4,934,855 | 6/1990 | Recchelbacher | 132/148 X |

*Primary Examiner*—John J. Wilson
*Assistant Examiner*—Jeffrey A. Smith
*Attorney, Agent, or Firm*—Malin, Haley, DiMaggio & Crosby

[57] ABSTRACT

A hair treatment appliance having improved dispensing capable of multi-faceted operation in the care and treatment of human hair. A body is provided having generally a hollow chamber therein to receive an aerosol container. An opening in a wall of the chamber permits a dispensing valve of the aerosol container residing therein to dispense the contents of the container therethrough. A comb is secured to an end of the body and extends outwardly therefrom, while at the opposite end, hair lifters, which are a plurality of spaced apart elongated members, are optionally provided. A cap is generally provided adjacent one end of the hollow body and acts as a closure for the hollow chamber that receives the aerosol container. The aerosol container is actuated by a linear moving trigger secured to the body on the opposite side of the opening.

6 Claims, 2 Drawing Sheets

HAIR TREATMENT APPLIANCE

BACKGROUND OF THE INVENTION

1. Field of the Invention

The present invention relates generally to a hair treatment appliance and more particularly to a comb and hair spray container/dispenser combination having an improved dispensing trigger and reusable aerosol hair spray container housing to prevent nozzle rotation.

2. Background of the Invention

A device that employs a comb in combination with a hair spray dispenser is known in the art. U.S. Pat. No. 3,960,160, issued to Applicant, discloses a hair treatment appliance capable of multi-faceted operation such as combing and applying hair spray. However, the aerosol spray container used in conjunction with the device has been known to turn, and thus become misaligned with the opening used for exiting the aerosol spray, due to the rotational forces applied when utilizing the trigger mechanism taught in U.S. Pat. No. 3,960,160. Additionally, the trigger design of U.S. Pat. No. 3,960,160 has been known to bend the valve stem associated with the trigger. The present invention overcomes these problems by providing a hair treatment appliance having an improved trigger system and container mount which prevents the aerosol spray container from turning when the user activates a trigger to discharge aerosol spray. Additionally, the improved trigger system can not bend the container valve stem.

The present invention also provides for a trigger mechanism on the spray dispenser that prevents the dispenser from being accidentally actuated. Also, the improved trigger mechanism prevents any spray from being dispensed from inside a blister pack package caused by accidental pressing on the blister pack.

SUMMARY OF THE INVENTION

The hair treatment appliance of the present invention preferably embodies three features, namely, a comb, a refillable aerosol container and a hair lifter device. All three of these elements in combination may be afforded on a single, compact appliance to permit hair to be properly cared for and/or manipulated by a stylist or a consumer.

The removable aerosol container is preferably received in a hollow chamber that extends axially along the body of the appliance. Preferably, the container is refillable and is guided into the hollow chamber of the body to facilitate alignment between the dispensing nozzle and the slotted opening. Spring means received in the closure cap is also provided to apply pressure against the lower end of the aerosol container and thus insure that the dispensing nozzle is held in the proper position. Once in position, a finger trigger, essentially engages the upper side of the dispensing nozzle.

The trigger extends through the body by a trigger opening in the body. The trigger contains at least one flange member extending outwardly from the trigger. A slot within the body is located at the trigger opening to receive the flange member and to prevent the trigger from being removed out of the trigger opening. The slot along with the flange member combine to also prevent the trigger from pivoting. However, the trigger is allowed to move in a straight up and down direction, and when depressed, actuates the nozzle and dispenses the contents of the spray container.

The dispensing nozzle has at least on flat side which is in mesh relationship with a flat member molded to the interior of the body and extending inwardly towards the hollow chamber. This mesh relationship between the flat side and flat member prevents the nozzle from turning when the trigger is pressed. Once the aerosol container is spent, the closure cap can be removed and the container withdrawn for refilling or replacement.

From the standpoint of the comb feature, embodiments are presented wherein the teeth of the comb are alternately long and short to assist in proper handling of the hair and also of particular geometrical configuration. Moreover, while generally speaking, the comb extends axially outwardly from the appliance along a center line through the body, it is also an advantage and thus a further embodiment of the present invention to offset the comb to the outer edge of the appliance body.

A hair lifter, which is a plurality of spaced apart elongated metal elements, is secured to the closure and extends outwardly therefrom so as to provide the triple-faceted hair treating appliance.

It is an object of the present invention to provide an improved hair treatment appliance.

It is another object of the present invention to provide an improved hair treatment appliance which is a combination appliance for the treatment of hair wherein a hair conditioning material container is housed in a body that also provides a comb and, optionally, hair lifters.

It is yet another object of the present invention to provide an improved, compact hair treatment appliance.

It is still another object of the present invention to provide an improved hair treatment appliance which has an improved trigger mechanism to prevent bending of an associated valve stem.

It is a further object of the present invention to provide an improved hair treatment appliance which not turn an associated aerosol spray nozzle when discharging aerosol spray.

It is still further an object of the present invention to provide an improved hair treatment appliance which is relatively low in cost and easy to manufacture.

DESCRIPTION OF THE PREFERRED EMBODIMENT

Figure 1:
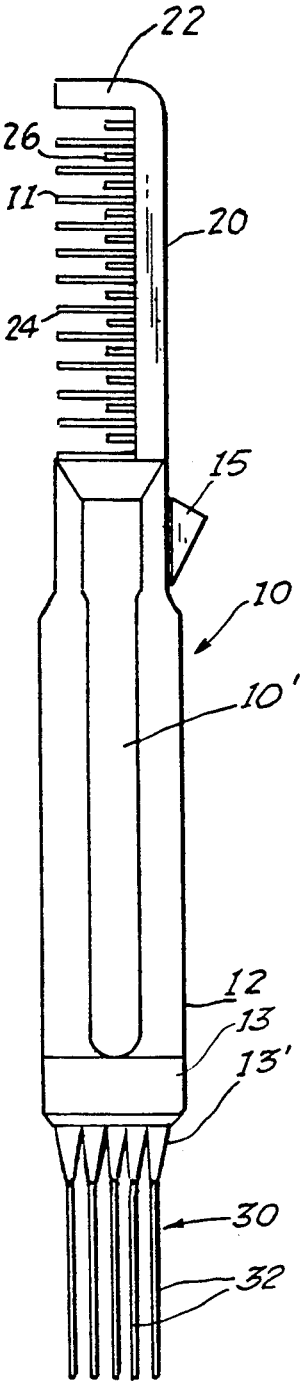
FIG. 1 is a side elevational view of a hair treating appliance according to the present invention.
Figure 2:
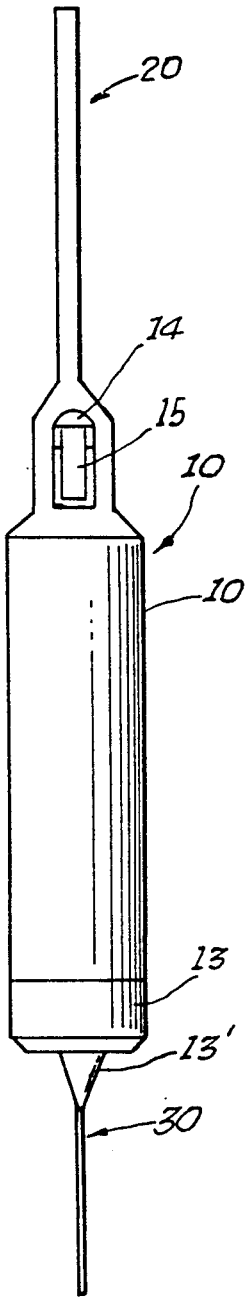
FIG. 2 is a rear view of the appliance as shown in FIG. 1.
Figure 3:
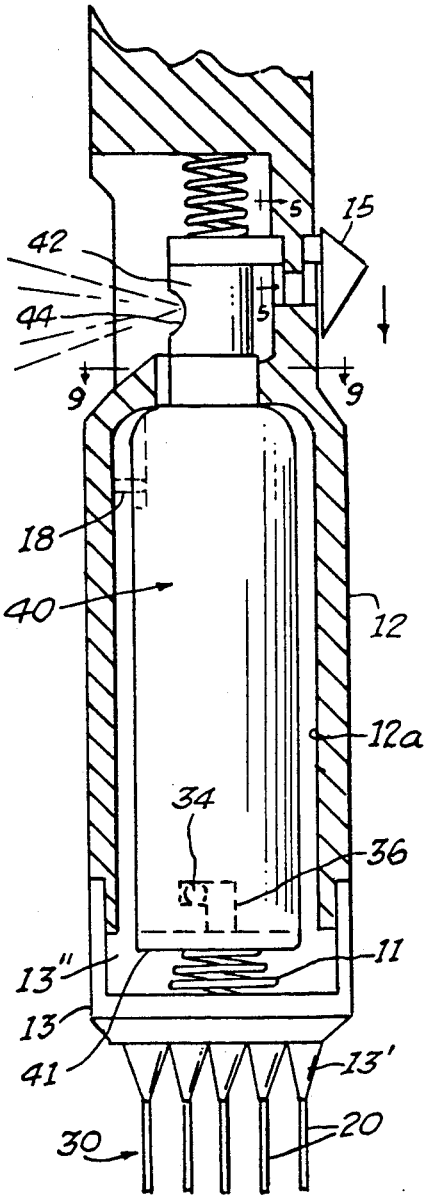
FIG. 3 is a partial cross sectional view of the hair treating appliance according to the teachings of the present invention.
Figure 7:
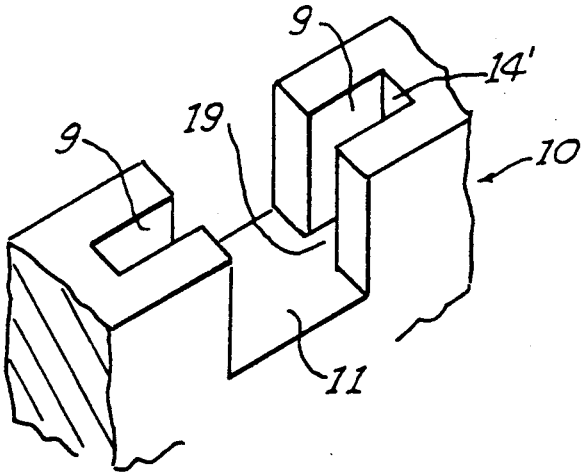
FIG. 7 is a perspective view of the trigger opening of the hair treating appliance according to the teachings of present invention.

Referring to the drawings, the preferred embodiment of the present invention will now be described in detail. In FIGS. 1 through 3, the hair treating appliance of the present invention is shown generally at 10 having a cylindrical body 12 with narrow teeth 11 forming a comb section 20 secured thereto and extending upwardly therefrom in an axial direction generally along the center line of body 12. A hair lifter element generally indicated as 30 having long then rigid teeth 13*a* is shown at an opposite end of body 10. Body 12 is elongated and has a hollow inside chamber 12*a* one end of chamber 12*a* having a closure cap 13 secured by an interlock in suitable fashion. Body 12 further has a dispensing slot opening 14 to permit aerosol hair spray to be dispensed, and an opposite trigger opening 14'. A trigger 15 is suitably received in trigger opening 14' adjacent hollow chamber 11 of body 12 and is held within body 12 and opening 14' by slot 9 of inner periphery 14" in a manner which will be described hereinafter. As illustrated in FIG. 1, the exterior of body 10 may be provided with suitable flat surface areas 10' or the like to suitably conform the body 12 to the user's hand, and thus afford a better and more comfortable fit.

Comb section 20 as shown in FIG. 1 extends outwardly from body 12 along a central longitudinal axis therethrough and comprises a rigid unitarily formed backbone 22 having a plurality of teeth 24 and 26 extending outwardly in a plane therefrom in a direction transverse to the elongated direction of body 12. As can be seen in FIG. 1, long teeth 24 and short teeth 26 alternate along the length of backbone 22 to afford an improved tooth arrangement for the comb.

At an opposite end of body 10 secured to closure 13 are a plurality of lifter members 32 that define hair lifter element 30. Lifter members 32 are preferably elongated metal rods that are secured to surrounding plastic ferrule-like sections 13' that protrude from end closure 13. Hair lifter members may also be produced from a plastic material, though metal is preferred due to the fact that the metal elements are more durable and may be thinner better penetrate the hair.

Closure 13 may be secured to body 10 in any suitable fashion. For example, FIG. 3 illustrates a pin-slot arrangement. A pin 34 is secured to a portion of body 12 that receives cap 13. A mating slot 36 is provided on the inner periphery 13" of closure 13. In suitable fashion, slot 36 extends spirally around the inner periphery 13" of closure 13 so as to permit a lock upon turning closure 13 therearound with pin 34 passing therealong.

A small aerosol container 40 is shown received in chamber 12*a* of body 12 in FIG. 3. Closure cap 13 received over the lower end thereof holds container 40 within compartment 12*a* and spring 17 received within cap 13 applies spring tension against container 40. Aerosol container 40 has a dispensing valve 42 secured at one end thereof with a nozzle 44 in alignment with opening or slot 14 of body 12. Coil spring 17 is secured within closure 13 and applies spring tension against a lower end of aerosol container 40, whereby dispensing valve 42 is held in contact with a trigger 15.

A pin 18 can be provided within chamber 12*a* and extending inwardly against an outer grooved surface of container 40 as shown in phantom, for aligning container 40 within body 12.

As seen in FIGS. 3–7, a finger activated trigger 15 is provided for the appliance and upon longitudinal movement thereof, an underside rigid flat surface 15" forces dispensing valve 42 downwardly and provides an aerosol spray of the contents from container 40 to exit through nozzle 44 and slot 14 of body 12. Trigger 15 contains flange members 15' extending outward from and perpendicular to trigger 15. Trigger 15 is secured within body 10 and trigger opening 14' by flange members 15' cooperating with slot 9. Before attaching comb 20 to body 10, trigger 15 is placed within trigger opening 14' of body 10, which allows flange members 15' to be aligned within and received by their respective slots 9. Before inserting aerosol container 40 within chamber 12*a*, trigger 15 rests along ledge 19 of body 10. After attaching comb 20 to body 10, trigger 15 is prevented from being removed from trigger opening 14' by the combination of flange members 15' located within slots 9. In addition, trigger 15 is also prevented from rotating by flange members 15' and slots 9. However, trigger 15 can move in a straight up and down direction within trigger opening 14' as flange members 15' are able to move in a straight up and down direction within slots 9. Thus, trigger 15 can not pivot.

Preferably, aerosol container 40 is refillable by removal of the dispensing valve 42 after which additional material (hair spray) may be placed within container 40 suitable for aerosol dispensing. The refillable characteristics of the container 40, however, does not form a structural feature of the present invention, per se. Hence, particular details of structure of the container so as to facilitate refilling are not believed to be necessary, since such details are well within the purview of those skilled in the art. Container 40 is aligned to insure that dispensing valve 42 and nozzle 44 are adjacent slot 14 for dispensing therethrough.

Figure 8:
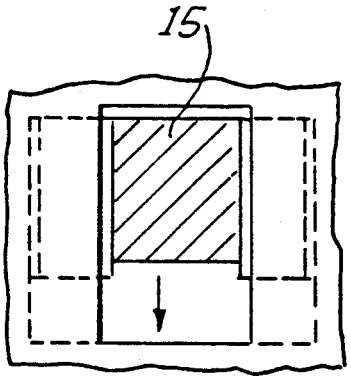
FIG. 8 is a partial cross sectional view taken along line 5—5 of FIG. 3.
Figure 4:
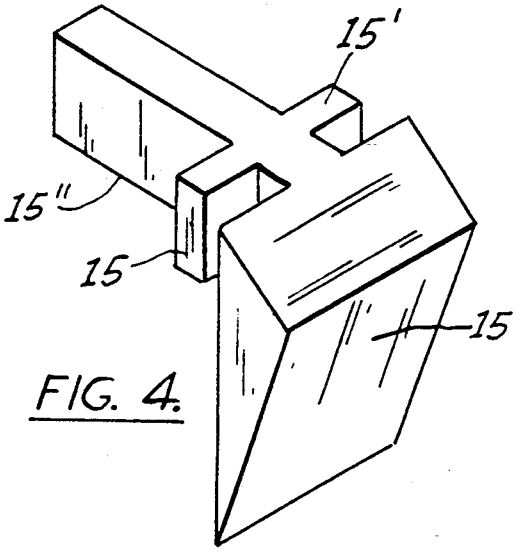
FIG. 4 is a perspective view of the improved trigger according to the teachings of the present invention.
Figure 5:
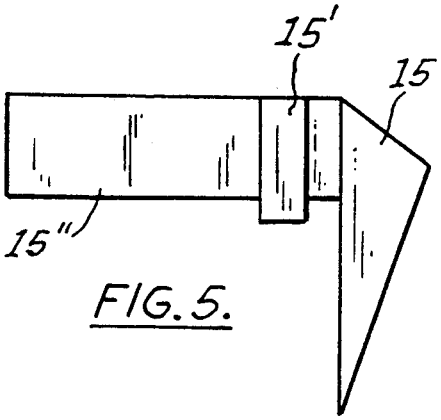
FIG. 5 is a side view of the trigger as shown in FIG. 4.
Figure 9:
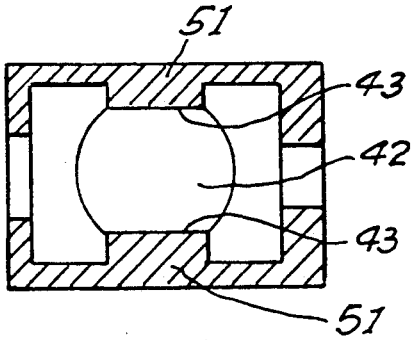
FIG. 9 is a cross sectional view taken along line 9—9 of FIG. 3.
Figure 6:
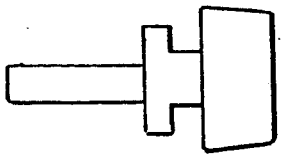
FIG. 6 is a top view of the trigger as shown in FIGS. 4 and 5.

As seen in FIGS. 8 and 9, to prevent valve 42 and nozzle 44 from turning when trigger 15 is pressed, at least one flat member 51 is molded to body 10. As seen in FIGS. 8 and 9, dispensing valve 42 has at least one flat side 43. Side 43 and flat member 51 fits adjacent and mesh to each other in order to prevent valve 42 from turning. Preferably, valve 42 has two flat sides 43 in mesh relationship with two molded flat members 51. Thus, misalignment and/or the necessity of manual alignment is avoided.

With the improved trigger mechanism and container housing, the reliability and accuracy of dispensing hair spray is greatly improved.

While the instant invention has been described in what is considered to be the preferred embodiment, it is to be understood that these descriptions are given by means of example only, and not by means of limitation. It is to understood that changes and modifications may be made to the description given and still be within the scope of the invention. Further, it is clear that obvious changes and modifications will occur to those skilled in the art.

What is claimed is:

1. A hair treatment appliance comprising:

an elongated body having a hollow chamber, said elongated body having a proximal and distal end, said body having a pair of oppositely positioned openings near said proximal end;

trigger means moving along said body, a portion of said trigger means extending outwardly through a first of said pair of openings in said body;

a closure cap securable at said distal end of said body;

an aerosol container receivable in said chamber, said container having a dispensing valve engageable with said trigger means, said valve being directed towards a second of said pair of openings in said body to expel an aerosol spray through said second opening when said trigger means is depressed;

means for securing said trigger means within said first of said pair of openings in said body and for preventing said trigger means from pivoting when said trigger means is depressed;

means for preventing said valve from turning when said trigger means is depressed; and comb means removably secured to said proximal end of said elongated body and extending outwardly therefrom.

2. The hair treatment appliance of claim 1, wherein said closure cap further includes a plurality of elongated hair lifter elements secured thereto and extending outwardly therefrom in a generally parallel arrangement to said comb means.

3. The hair treatment appliance of claim 1, wherein said valve has at least one flat side.

4. The hair treatment appliance of claim 3, wherein said means for preventing comprises at least one flat member molded to said body at said proximal end and extending inwardly within said chamber, wherein said flat member is in mesh relationship with said flat side to prevent said valve from turning when said trigger means is depressed.

5. The hair treatment appliance of claim 1, further including at least one flange member depending outwardly from and perpendicular to said trigger means.

6. The hair treatment appliance of claim 5, wherein said means for securing is at least one slot in said body at said first opening, wherein said flange member is received within said slot to secure said trigger means within said first opening, said slot and said flange member preventing said trigger means from pivoting around said valve.

* * * * *